US008356496B2

(12) United States Patent
Moschütz

(10) Patent No.: US 8,356,496 B2
(45) Date of Patent: Jan. 22, 2013

(54) APPARATUS AND METHOD FOR LOADING ITEMS TO BE WASHED WITH AN AIR FLOW

(75) Inventor: Harald Moschütz, Groβbeeren (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1215 days.

(21) Appl. No.: 12/085,641

(22) PCT Filed: Nov. 8, 2006

(86) PCT No.: PCT/EP2006/068222
§ 371 (c)(1),
(2), (4) Date: May 27, 2008

(87) PCT Pub. No.: WO2007/065768
PCT Pub. Date: Jun. 14, 2007

(65) Prior Publication Data

US 2009/0044576 A1 Feb. 19, 2009

(30) Foreign Application Priority Data

Dec. 6, 2005 (DE) ..... 10 2005 058 285

(51) Int. Cl.
*D06F 58/24* (2006.01)
*D06F 58/26* (2006.01)
*F26B 11/04* (2006.01)
*F26B 3/04* (2006.01)

(52) U.S. Cl. ..... 68/20; 8/149.2; 34/468; 34/487; 34/499; 34/72

(58) Field of Classification Search ..... 68/5 C, 68/12.15, 20; 8/149.2; 34/73, 77, 78, 90, 34/109, 139; 134/37
See application file for complete search history.

(56) References Cited

U.S. PATENT DOCUMENTS 3,314,255 A * 4/1967 Neumann et al. ..... 68/20
(Continued)

FOREIGN PATENT DOCUMENTS

DE 1 410 206 10/1968
(Continued)

OTHER PUBLICATIONS

JP04352999; Matsumoto, T.; Dec. 8, 1998; English abstract.*
(Continued)

*Primary Examiner* — Michael Kornakov
*Assistant Examiner* — Natasha Campbell
(74) *Attorney, Agent, or Firm* — James E. Howard; Andre Pallapies

(57) ABSTRACT

An apparatus for loading items to be washed with an air flow, comprising a substantially closed first channel system for guiding an air flow which loads the items to be washed. A treatment chamber for receiving the items to be washed, a blower for driving the air flow, a heater for heating the air flow before the items to be washed are loaded, and a cooler for cooling the air flow after the items to be washed have been loaded are arranged in the first channel system. Here, the first channel system has outside the treatment chamber and the blower, two branches and which are connected to one another in parallel and can be flowed through in parallel by corresponding parts of the air flow. Here, the heater is arranged in a first branch and the cooler is arranged in a second branch of said branches. The invention likewise relates to a corresponding method.

21 Claims, 3 Drawing Sheets

U.S. PATENT DOCUMENTS 3,739,487 A 6/1973 Clark

FOREIGN PATENT DOCUMENTS

| | | |
|---|---|---|
| DE | 34 46 468 | 7/1986 |
| DE | 43 06 217 | 9/1994 |
| DE | 197 38 735 | 3/1999 |
| DE | 201 01 641 U | 6/2002 |
| EP | 0 467 188 | 1/1992 |
| EP | 1 205 592 | 5/2002 |
| EP | 1 342 828 | 9/2003 |
| GB | 2 094 961 | 9/1982 |
| JP | 4-352999 | 12/1992 |
| JP | 8-57194 | 3/1996 |

OTHER PUBLICATIONS

English translation of JP 04352999, T. Matsumoto, Dec. 8, 1992.*
Partial (claims) machine translation of DE 20101641, AKG Thermotechnik GmbH & Co, Jun. 6, 2002.*
Derwent English abstract of DE 20101641, AKG Thermotechnik GmbH & Co, Jun. 6, 2002.*
Machine translation of EP 0467188, Zelt et al., Jul. 8, 1991.*
International Search Report PCT/EP2006/068222, dated Jan. 30, 2007.

* cited by examiner

APPARATUS AND METHOD FOR LOADING ITEMS TO BE WASHED WITH AN AIR FLOW

BACKGROUND OF THE INVENTION

The invention relates to an apparatus for loading items to be washed with an air flow, comprising a substantially closed first channel system, for forcibly guiding an air flow loading the items to be washed, in which first channel system are arranged a treatment chamber for receiving the items to be washed, a blower for driving the air flow, a heater for heating the air flow before the items to be washed are loaded, and a cooler for cooling the air flow after the items to be washed have been loaded. The invention also relates to a method for loading items to be washed with an air flow, which is forcibly guided in a first channel system described above.

Such an apparatus and such a method are revealed from EP 0 467 188 B1, the disclosure thereof being included in the present disclosure in its entirety. In the apparatus there for drying items to be washed, the heater and the cooler are components of a heat pump device and, in this heat pump device, the cooler forms an evaporator and the heater forms a condenser for an operating fluid circulating in a corresponding circuit. The first channel system, in which the air flow is guided, is substantially closed—this means that during operation according to the intended purpose the air flow circulates substantially without leakages, but does not adopt a substantially higher pressure than the air surrounding the apparatus. The air flow is in this case substantially driven by the blower and thus forcibly guided through the first channel system; convection and similar lifting effects play a subordinate role, however, for driving the air flow. If required, the channel system may be connected to the surroundings by opening a flap, in particular in order to discharge from the apparatus a part of the air flow heated during operation and to replace said part of the air flow with relatively cool air from the surroundings. The treatment chamber for receiving the items to be washed is designed as a rotatable drum.

A washing machine is revealed from DE 1 410 206 A, in which items to be washed are not only able to be washed but also dried. The publication shows a plurality of alternatives for the additional devices required therefor; in particular, an electrical heating apparatus may be provided for heating an air flow used for drying items to be washed and a simple heat exchanger for cooling the heated air flow after loading the items to be washed, but the heater and the cooler may also form part of a heat pump device. The heat pump device may be designed as the heat pump device disclosed in EP 0 467 188 B1, but it may also be a heat pump device which operates with Peltier elements for utilizing the thermoelectrical effect.

An apparatus for drying items to be washed of the type described in the introduction is revealed from DE 19 738 735 C2, in which a heat pump device is used which operates according to an absorption principle.

An apparatus for drying items to be washed revealed from an English extract from the data collection "Patent Abstracts of Japan" belonging to JP 08 057 194 A, which in turn corresponds to the type described in the introduction, contains in its first channel system in addition to a heater and a cooler which both form part of a heat pump device which may be thermoelectrically operated, an additional heat exchanger arranged upstream of the cooler for cooling the air flow discharged by the items to be washed and an additional heating device arranged downstream of the heater for further heating of the air flow before the loading of the items to be washed. An apparatus for drying items to be washed is also revealed from DE 3 509 549 A1, which in addition to a heat pump device with a cooler and heater comprises a further heating device as well as additional heat transport devices such as gravitation heat pipes.

It is common to all disclosed devices and methods of the prior art that the components thereof required for loading the items to be washed with the air flow are arranged in succession in the channel system provided for guiding the air flow. Such an arrangement sets specific requirements for implementation in an apparatus intended for and suitable for use in a normal domestic environment. Due to the limited amount of available space, these requirements may dictate that components of the channel system have to be designed relatively small and therefore with a relatively high flow resistance for the air flow; this may considerably impair the effect of the drying process taking place in the apparatus, as in this case an air flow with a restricted volumetric flow rate has to be forced through a channel system, possibly causing detrimental frictional losses and throttle losses. This problem is particularly pronounced when a heat pump device is to be inserted in the apparatus, in particular a thermoelectric heat pump device. Particularly in the case of the thermoelectric heat pump device, in an apparatus which is used in a domestic washer-dryer with conventional external dimensions, the channel system has to be repeatedly folded.

A drying apparatus for drying items to be washed by means of an air flow is revealed from DE 32 04 718 A1 which comprises a drying chamber for receiving the items to be washed, a heating element for heating up the air flow and a condensation element for extracting moisture from the air flow. In this connection, lifting effects and negative lifting effects, which occur as a result of heating or cooling the air flow or a portion of the air flow, are utilized for forcing the air flow in each case. In particular, a lifting effect in the heating element is utilized in each disclosed embodiment of the drying apparatus. The condensation element may contain a combination of a blower and a valve for assisting its effect; the heating element and the condensation element may be corresponding components of a heat pump system.

One of ordinary skill in the art at the time of the invention will understand the basis, function and application of Peltier elements.

BRIEF SUMMARY OF THE INVENTION

Accordingly, the invention to be described hereinafter is based, amongst others, on the object of providing an apparatus and method of the type described in the introduction which avoids the drawbacks described above of a channel system containing a plurality of components in succession and possibly repeatedly folded.

To solve this object, an apparatus is provided for drying items to be washed, comprising a substantially closed first channel system, for forcibly guiding an air flow loading the items to be washed, in which first channel system are arranged a treatment chamber for receiving the items to be washed, a blower for driving the air flow, a heater for heating the air flow before the items to be washed are loaded and a cooler for cooling the air flow after the items to be washed have been loaded, in which apparatus according to the invention the first channel system outside the treatment chamber and the blower has two branches connected in parallel to one another, which may be flowed through in parallel by corresponding parts of the air flow, the heater being arranged in a first branch and the cooler being arranged in a second branch of said branches.

To solve this object, a method is also provided for loading items to be washed with an air flow, which is forcibly guided in a substantially closed first channel system, in which first channel system are arranged a treatment chamber for receiving items to be washed, a blower for driving the air flow, a heater for heating the air flow before the items to be washed are loaded and a cooler for cooling the air flow after the items to be washed have been loaded, in which method the air flow is divided outside the treatment chamber and the blower into two parts guided in parallel to one another, of which a first part flows through the heater and of which the second part flows through the cooler, after which the parts are combined again with one another.

In contrast to an example which may be derived from considering the drying process in functional terms, the invention provides that the cooling of the forcibly guided air flow for condensing moisture which has been removed from the items to be washed, and the heating of the air flow before the loading of the items to be washed, in order to facilitate the removal of moisture from the items to be washed at a higher temperature, do not take place in succession but at the same time.

A prerequisite therefor is the recognition according to the invention that in a conventional washer-dryer, even an approximately complete removal of moisture from the air flow flowing out of the items to be washed which are to be dried never takes place and that a removal of moisture to the usual extent may be achieved when only one part of the air flow flowing out of the items to be washed is subjected to the removal of moisture. The invention also advantageously utilizes the fact that an air flow absorbs heat better, the more damp it is, and thus the drawback of having to incorporate a given amount of heat into only one part of the total air flow and having to bring this part to a correspondingly higher temperature, may be compensated.

A great advantage of the invention is, however, that the parallel arrangement and through-flow of the heater and the cooler provides an available flow cross-section which is substantially doubled for the forcibly guided air flow and thus markedly reduces a pressure drop which occurs during the through-flow of the arrangement made up of the cooler and heater, relative to each disclosed apparatus of the prior art; this reduction is particularly high as the cooler and the heater no longer have to be flowed through in succession, adding together their flow resistances.

Preferably, the second branch on the outlet side of the cooler has a separator for removing moisture from the corresponding part of the air flow. As a result of this separator, moisture which has been condensed in the cooler from the air flow is removed from the air flow and supplied to a suitable collection container. It is also advantageous to remove the moisture before recombining the parts of the air flow, as the cooled part of the air flow is heated again as a result of recombining and therefore condensed moisture could be evaporated again.

The treatment chamber of the apparatus is preferably rotatable and, in particular, configured as a drum for receiving the items to be washed, the drum on the inside being provided with strip-like drive elements. In such a drum, the items to be washed may be moved in the air flow loading said items to be washed and agitated, which is required for a uniform removal of moisture of the items to be washed by substantially avoiding creasing in the items to be washed.

A particularly preferred embodiment of the apparatus is characterized in that the heater and the cooler form part of a heat pump device, in particular a heat pump device which may be thermoelectrically operated, which pumps heat from the cooler to the heater. In each heat pump device, the cooler and the heater form critical components which may be designed and constructed only by taking account of awkward boundary conditions which, due to their cooperation in the heat pump device, expediently have to be positioned relatively close to one another, which as regards the spatial conditions in a conventional washer-dryer may lead to constructional difficulties. In particular in a heat pump which may be thermoelectrically operated, the cooler and the heater, according to the principle, are closely adjacent to one another in spatial terms, as they are arranged on two sides parallel to one another of a contact unit provided with the required Peltier elements and which is more or less of flat rectangular shape. In a conventional washer-dryer, the cooler and the heater are arranged beneath the treatment chamber; the air flow is guided from a rear face of the washer-dryer through the treatment chamber to a front face, from there into the space beneath the treatment chamber and at that point from the front face back to the rear face. This means that a channel system arranged beneath the treatment chamber with a thermoelectric heat pump for guiding the air flow has to be folded in an S-shape which requires the air flow to cover a particularly large distance and thus a relatively high flow resistance.

Particularly preferably, the heat pump device in the apparatus comprises at least one thermoelectric contact unit with a warm side and a cold side, the cold side being integrated in the cooler and the warm side being integrated in the heater. Moreover, the contact unit in this case preferably has a plurality of Peltier elements arranged side by side and between two thermally conductive plates, the cold side and the warm side being formed respectively by one thermally conductive plate. Additionally, preferably the cold side and the warm side are respectively provided with thermally conductive ribs in order to improve the heat transfer to the air flow.

Also preferably, the cooler is additionally configured as a heat exchanger for an additional cooling medium and is connected to a second channel system for guiding the additional cooling medium. Air is provided, in particular, as additional cooling medium. The heat exchanger for the additional cooling medium is used in particular during a cooling phase provided following the drying of items to be washed, during which the apparatus, the air flow and the items to be washed are cooled. This is advantageous for avoiding creasing in the items to be washed, as creases are formed more easily, the higher the temperature of the items to be washed.

A particularly preferred apparatus comprising a heat pump device which may be thermoelectrically operated, is characterized by two thermoelectric contact units and a cooler divided into two halves connected to one another in parallel, the warm side of each contact unit being integrated in the heater and the cold side of each contact unit being integrated in one of the halves. In this manner, a relatively compact structure results in which the heater is arranged between the thermoelectric contact units and the thermoelectric contact units are layered with the heater between the halves of the cooler. In this construction, the heater is particularly well protected from undesirable heat losses. The structure provides a particularly low flow resistance for the air flow, has a small space requirement and is very well suited for being equipped with a cooler which as described above is additionally configured as a heat exchanger for an additional cooling medium. In this case, the heat exchanger for an additional cooling medium is also divided into two corresponding halves, of which each is associated with a corresponding half of the cooler.

The apparatus according to the invention is, in particular, configured as a domestic washer-dryer.

A preferred development of the invention provides that, after recombining the parts, the air flow reaches the blower and passes from the blower to the treatment chamber.

Preferred embodiments of the method according to the invention correspond to preferred embodiments of the apparatus according to the invention and vice versa.

The above description of the invention as well as preferred embodiments, the cooler and the heater respectively being described as components which are unique of their kind, does not exclude that, according to the purpose of use and the conditions of use an additional cooling device, an additional heating device or a combination of such is used. Reference is further made to the corresponding references in the cited documents of the prior art.

BRIEF DESCRIPTION OF THE DRAWINGS

Embodiments of the invention are described hereinafter with reference to the drawings. The drawings are understood to be diagrams or sketches and not in any way to be understood as representations of a real embodiment which is true-to-scale, in which in detail.

DETAILED DESCRIPTION OF THE PRESENT INVENTION

Figure 1:
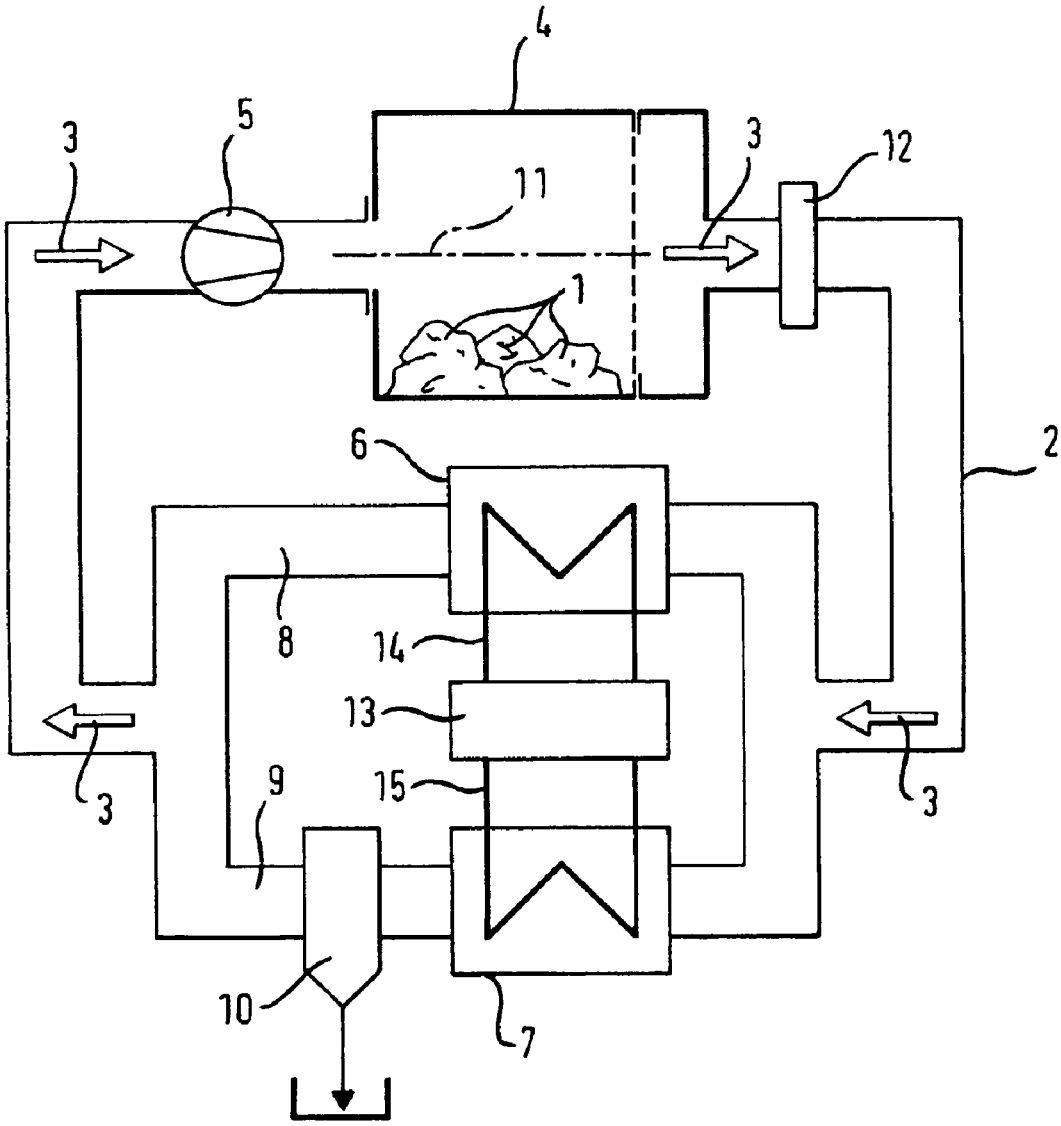
FIG. 1 shows a function diagram of an apparatus for drying items to be washed.

FIG. 1 shows an apparatus for drying items to be washed 1, comprising a substantially closed first channel system 2 for forcibly guiding an air flow 3 loading the items to be washed 1. In the first channel system 2 are arranged a treatment chamber 4 for receiving the items to be washed 1, a blower 5 for driving the air flow 3, a heater 6 for heating the air flow 3 before the items to be washed 1 are loaded and a cooler 7 for cooling the air flow 3 after the items to be washed 1 have been loaded. In this case, the first channel system 2 is divided outside the treatment chamber 4 and the blower 5 into two branches 8 and 9 connected in parallel to one another, which branches 8 and 9 may be flowed through in parallel by corresponding parts 20 and 21 of the air flow 3. The heater 6 is arranged in a first branch 8, and the cooler 7 in a second branch 9 of said branches. During operation of the apparatus, the blower 5 forces the air flow 3 through the first channel system 2; upstream of the heater 6 and the cooler 7, the air flow 3 is divided into two parts 20 and 21, and the heater 6 or the cooler 7 flowed through in parallel by these parts 20 or 21. This arrangement with the heater 6 and the cooler 7 has a particularly low flow resistance for the air flow 3. In the second branch 9, a separator 10 follows the cooler 7, which is intended for removing moisture, which has been condensed from the corresponding part of the air flow 3 in the cooler 7. The condensed moisture may be removed from the separator 10 as indicated by the arrow.

The treatment chamber 4 is a drum 4 which may be rotated about the axis 11. By the rotation of the drum 4, the items to be washed 1 are moved in the air flow 3 and additionally agitated, in order to ensure a uniform drying result. For assisting this movement and agitation, the drum 4 may be provided with drive elements, not shown. After flowing through the drum 4, the air flow 3 firstly reaches a lint filter 12 arranged in the first channel system 2, where lint which the air flow 3 removes from the items to be washed 1, is collected in order not to block subsequent regions of the channel system 2, in particular the heater 6 or the cooler 7.

The heater 6 and the cooler 7 form part of a heat pump device which may thermoelectrically operated with a central unit 13 which contains Peltier elements 16, 22, 23, 24 (see FIG. 5) as functionally essential components and a warm side 14 and cold side 15 connected thereto in a thermally conductive manner. The warm side 14 forms a functionally essential component of the heater 6, and the cold side 15 also forms a functionally essential component of the cooler 7. The central unit 13 may also be denoted as a thermoelectric contact unit 13 as it is constructed from the aforementioned Peltier elements 16, 22, 23, 24 as well as additional thermally conductive components, as is described hereinafter in more detail.

Figure 2:
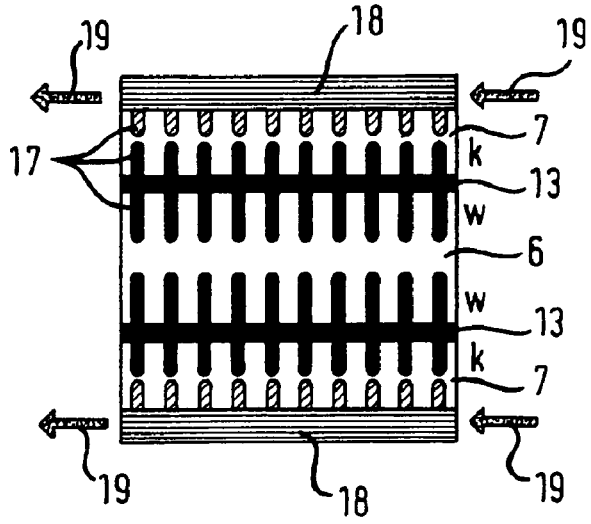
FIGS. 2, 3 and 4 show different views of a heat pump device which may be thermoelectrically operated for use in an apparatus for drying items to be washed.
Figure 3:
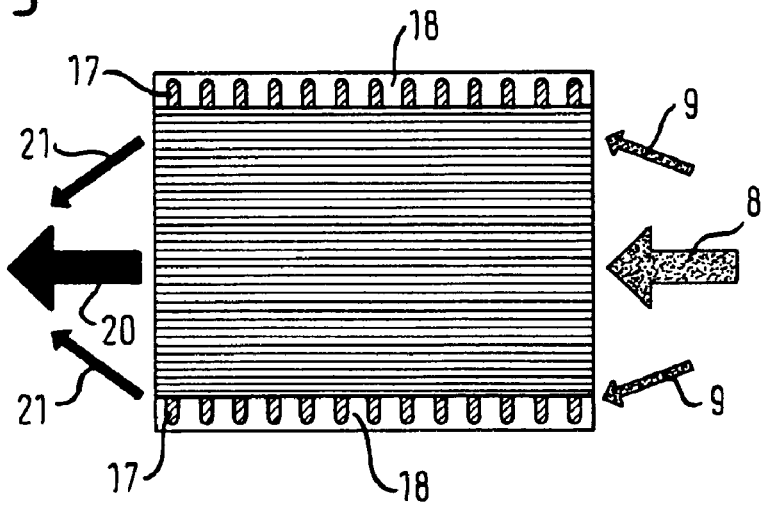
Figure 4:
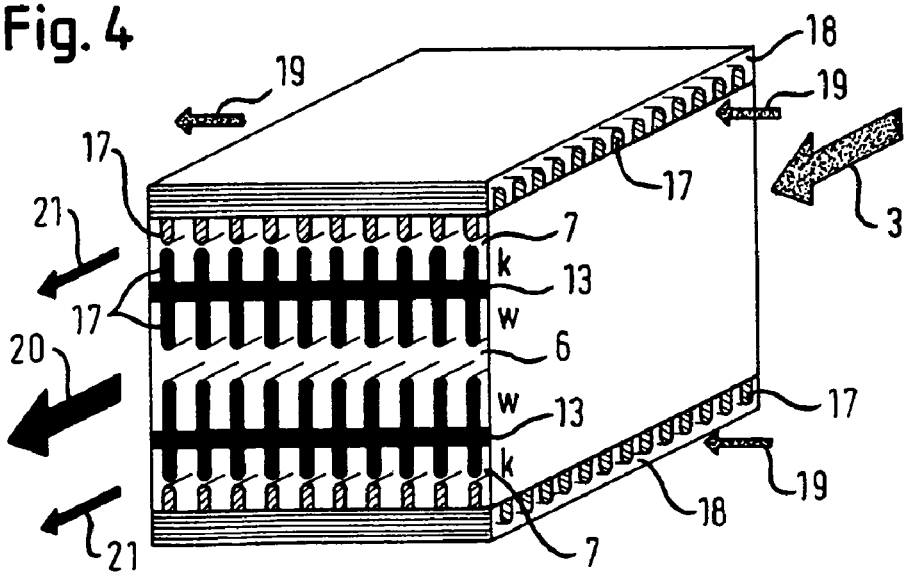

FIGS. 2, 3 and 4 show different views of a heat pump device for use in the device according to FIG. 1. The view according to FIG. 2 is a vertical section perpendicular to a flow direction of the air flow 3; FIG. 3 shows a view of one side of the device aligned vertically; FIG. 4 shows an oblique view of the device. In the following description, reference is made to FIGS. 2 to 4 together.

The device comprises two thermoelectric contact units 13 which encompass the heater 6 therebetween—in this case shown as a channel for a part of the air flow 3. To this end, the warm sides 14 denoted in this case by the letter w face one another, and the cold sides 15 denoted by the letter k face away from the heater 6. Each of the cold sides k forms with a second channel system 18 through which an additional cooling medium 19, in particular air, may be guided in the cross-flow of the air flow 3, respectively one half of the cooler 7, these two halves encompassing therebetween the heater 6 and the thermoelectric contact units 13.

Thermally conductive ribs 17 project into the heater 6, the halves of the cooler 7 and the halves of the second channel system 18, in order to improve the heat transfer between the different channels and the fluids flowing therein. Each half of the cooler 7 forms with the associated half of the second channel system 18 one half of an additional heat exchanger, which may serve to discharge additional heat from the cooler 7 and thus to increase the cooling effect. In the simplest case, the second channel system 18 is open and comprises the necessary channels as well as a further blower, in order to bring cool air from the surroundings of the apparatus to the heat pump device and from there into the surroundings again.

The heat pump device comprises both branches 8 and 9 (branch 9 is in turn divided) of the channel system 2 in a compact unit flowed through by corresponding parts 20 and 21 of the air flow 3 flowing parallel to one another. Behind this unit, the heated part 20 of the air flow 20 and the cooled part 21 of the air flow 21 are combined again with one another—it being understood that this takes place after removing the condensate which has accumulated in the cooled air flow 21, as indicated in FIG. 1.

Figure 5:
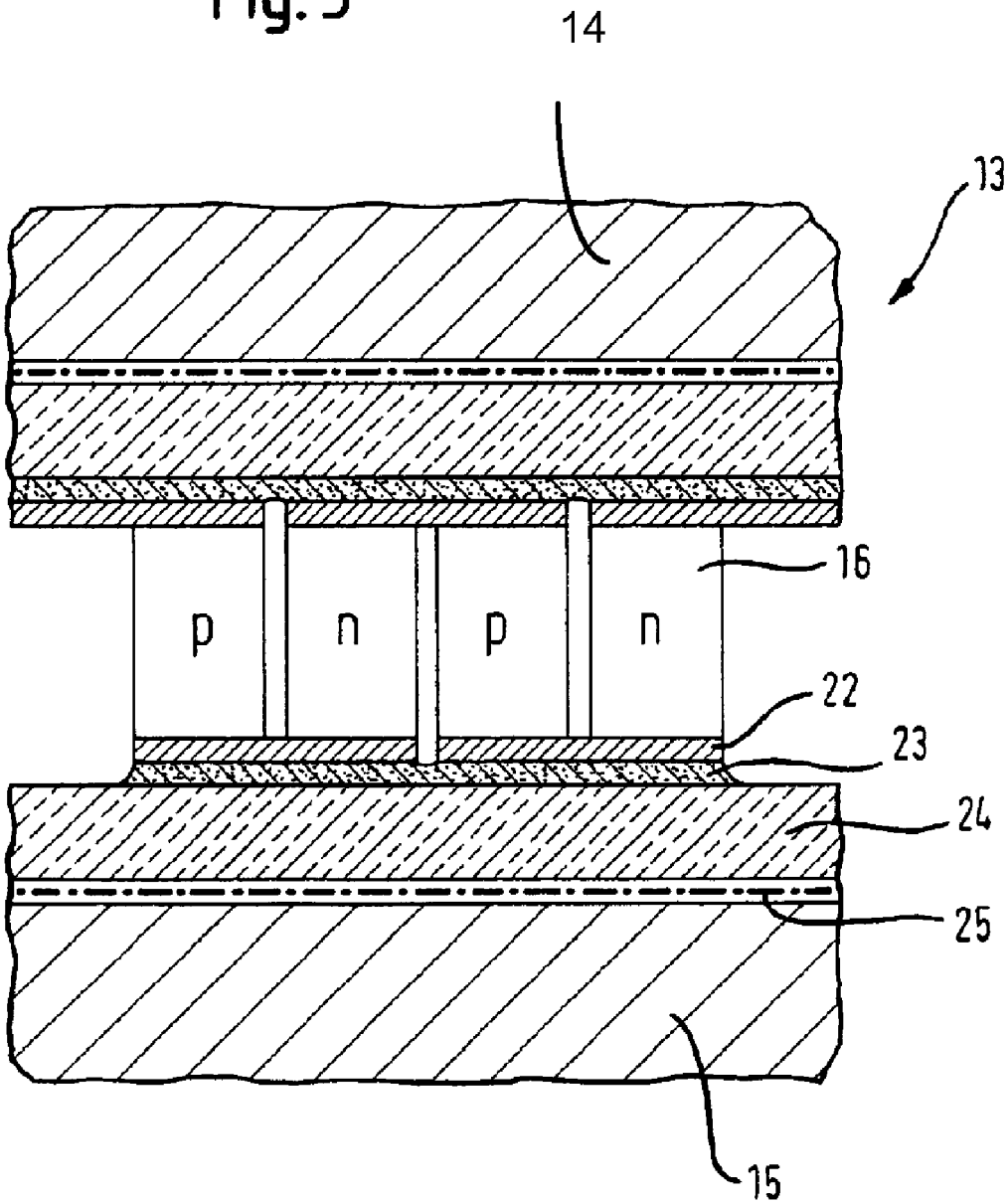
FIG. 5 show a sectional view of a central unit for a heat pump device which may be thermoelectrically operated.

FIG. 5 shows a vertical section through a thermoelectric contact unit 13.

Functionally essential components of the contact unit 13 are firstly Peltier elements 16, 22, 23, 24 which, when flowed through by a current, heat up at one end and cool down at the other end. The corresponding physical effect is denoted as a "Peltier effect" or "thermoelectrical effect". A Peltier element 16, 22, 23, 24 consists of a plurality of rectangular or columnar half elements 16 which respectively consist of one of two materials which are identified in FIG. 5 by the letters n and p. As materials, in particular bismuth telluride, antimony telluride and bismuth selenide are considered, respectively in n-conducting (n) or p-conducting doped form. Each half element 16 is welded on two opposing sides respectively onto a printed circuit board 22 (or a printed conductor located thereon), one printed circuit board 22 respectively being connected to two half elements 16 made of different materials n or p. The arrangement is, in the example shown in the present case, such that the half elements 16 are all arranged in series, and an arrangement of printed circuit boards 22 results on both corresponding sides of the plurality of half elements 15, which as a whole are arranged in one plane. The printed circuit boards 22 are connected on both sides of the half elements 16 via an adherent layer 23 to a ceramic plate 24 and available prefabricated in this form as "Peltier elements". In the arrangement shown in the present case, the ceramic plates 23 are connected in turn via a thermally conducting paste or thermally conducting film 25 to a thermally conductive plate 14 or 15; the thermally conductive plate 14 forms in this case the warm side 14, and the thermally conductive plate 15 forms the cold side 15 of the heat pump device. Reference is made to the fact that the arrangement shown in FIG. 5 is only to be understood as an example.

LIST OF REFERENCE NUMERALS

1 Items to be washed
2 First channel system
3 Air flow
4 Treatment chamber, drum
5 Blower
6 Heater
7 Cooler
8 First branch
9 Second branch
10 Separator
11 Axis of the drum
12 Lint filter
13 Heat pump device, central unit, thermoelectric contact unit
14 Warm side, thermally conductive plate
15 Cold side, thermally conductive plate
16 Peltier element, half element
17 Thermally conductive rib
18 Second channel system
19 Additional cooling medium
20 First (heated) part of the air flow
21 Second (cooled) part of the air flow
22 Printed circuit board, Peltier element
23 Adherent layer, Peltier element
24 Ceramic plate, Peltier element
25 Thermally conducting paste or thermally conducting film

The invention claimed is:

1. An apparatus for supplying an air flow to items to be washed, the apparatus comprising:

a substantially closed first channel system for forcibly guiding the air flow;

a treatment chamber, the treatment chamber arranged in the first channel system for receiving the items to be washed;

a blower for driving the air flow arranged in the first channel system;

a heater for heating the air flow before the items to be washed are supplied with the air flow; and a cooler for cooling the air flow after the items to be washed have been supplied with the air flow, wherein the heater and the cooler form part of a heat pump device that pumps heat from the cooler to the heater, wherein a portion of the first channel system excluding the treatment chamber and the blower has a first branch and a second branch connected in parallel to one another;

the first branch and the second branch dividing the air flow into a first part flowing through the first branch and a second part flowing through the second branch, the first part and the second part flowing through the first branch and the second branch in parallel; and the heater of the heat pump device being arranged in the first branch and heating the first part of the air flow, and the cooler of the heat pump device being arranged in the second branch and cooling the second part of the air flow, and the first branch and the second branch being combined downstream of the heater and cooler such that the first part and the second part of the air flow combine and flow toward the treatment chamber.

2. The apparatus as claimed in claim 1, wherein the cooler includes an inlet side and an outlet side; and wherein, on the outlet side of the cooler, the second branch includes a separator for removing moisture only from the corresponding part of the air flow in the second branch.

3. The apparatus as claimed in claim 1 wherein the treatment chamber is rotatable.

4. The apparatus as claimed in claim 1, wherein the heat pump device is thermoelectrically operated.

5. The apparatus as claimed in claim 4 wherein the heat pump device includes at least one thermoelectric contact unit with a warm side and a cold side, the cold side being integrated in the cooler and the warm side being integrated in the heater.

6. The apparatus as claimed in claim 5, wherein the at least one thermoelectric contact unit includes a plurality of Peltier elements arranged side by side and between two thermally conductive plates having the cold side and the warm side; the cold side and the warm side being formed respectively by one thermally conductive plate.

7. The apparatus as claimed in claim 5 wherein the cold side and the warm side respectively have thermally conductive ribs.

8. The apparatus as claimed in claim 1, wherein the cooler is configured as a heat exchanger for an additional cooling medium;

the apparatus further comprising a second channel system for guiding the additional cooling medium;

the cooler connected to the second channel.

9. The apparatus as claimed in claim 8 in which air is provided as the additional cooling medium.

10. An apparatus for supplying an air flow to items to be washed, the apparatus comprising:

a substantially closed first channel system for forcibly guiding the air flow;

a treatment chamber; the treatment chamber arranged in the first channel system for receiving the items to be washed;

a blower for driving the air flow arranged in the first channel system;

a heater for heating the air flow before the items to be washed are supplied with the air flow;

a cooler for cooling the air flow after the items to be washed have been supplied with the air flow, wherein a portion of the first channel system excluding the treatment chamber and the blower has a first branch and a second branch connected in parallel to one another;

corresponding parts of the air flowing through the first branch and the second branch in parallel;

the heater being arranged in the first branch and the cooler being arranged in the second branch;

wherein the heater and the cooler form part of a heat pump device, and wherein the heat pump device includes two thermoelectric contact units;

the cooler includes two halves connected to one another in parallel;

the warm side of each contact unit being integrated in the heater and the cold side of each contact unit being integrated in one of the halves.

11. The apparatus as claimed in claim 1 wherein the apparatus is configured as a domestic washer-dryer.

12. A method of supplying an air flow to items to be washed, the method comprising:

forcibly guiding an air flow in a substantially closed first channel system;

receiving items to be washed in a treatment chamber in the substantially closed first channel system;

driving the air flow using a blower;

heating the air flow with a heater before the items to be washed are supplied with the air flow;

cooling the air flow with a cooler after the items to be washed have been supplied with the air flow, wherein the heater and the cooler form part of a heat pump device that pumps heat from the cooler to the heater;

dividing the air flow outside the treatment chamber and the blower into a first part and a second part, and guiding the first part and the second part parallel to one another;

the first part flowing through the heater of the heat pump device and the second part flowing through the cooler of the heat pump device; and recombining the first part of the air flow with the second part of the air flow such that the first part and the second part flow toward the treatment chamber.

13. The method as claimed in claim 12 wherein, after recombining the first part and second part, the air flow reaches the blower and passes from the blower to the treatment chamber.

14. The method as claimed in claim 12 further including condensing the moisture from the second part;

removing the moisture before the second part is recombined with the first part.

15. The method as claimed in claim 12, further comprising pumping heat from the cooler to the heater by the heat pump device.

16. The method as claimed in claim 15 wherein in the cooler an additional heat exchange takes place at least at times between the second part and an additional cooling medium.

17. The method as claimed in claim 12 further including drying the items to be washed.

18. The apparatus as claimed in claim 10, wherein each of the two thermoelectric contact units includes a plurality of Peltier elements arranged side by side and between two thermally conductive plates having the cold side and the warm side;

the cold side and the warm side being formed respectively by one thermally conductive plate.

19. The apparatus as claimed in claim 10, wherein the cold side and the warm side respectively have thermally conductive ribs.

20. The apparatus as claimed in claim 10, wherein the cooler is configured as a heat exchanger for an additional cooling medium;

the apparatus further comprising a second channel system for guiding the additional cooling medium;

the cooler connected to the second channel.

21. The apparatus as claimed in claim 20, wherein the additional cooling medium comprises air.

* * * * *

UNITED STATES PATENT AND TRADEMARK OFFICE

CERTIFICATE OF CORRECTION

PATENT NO. : 8,356,496 B2
APPLICATION NO. : 12/085641
DATED : January 22, 2013
INVENTOR(S) : Harald Moschütz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1216 days.

Signed and Sealed this
First Day of September, 2015

Michelle K. Lee

Michelle K. Lee
*Director of the United States Patent and Trademark Office*